US008593391B2

(12) United States Patent
Okada et al.

(10) Patent No.: US 8,593,391 B2
(45) Date of Patent: Nov. 26, 2013

(54) LIQUID CRYSTAL DISPLAY DEVICE CONTROL CIRCUIT AND LIQUID CRYSTAL DISPLAY SYSTEM, WHICH ADJUST BRIGHTNESS OF DISPLAY IMAGE BY USING HEIGHT DISTRIBUTION OF GRADATIONS OF INPUT IMAGE

(75) Inventors: Tomokazu Okada, Kyoto-fu (JP); Yasunobu Inoue, Kyoto-fu (JP); Yasuhito Sugimoto, Kyoto-fu (JP)

(73) Assignee: Rohm Co., Ltd., Kyoto (JP)

( * ) Notice: Subject to any disclaimer, the term of this patent is extended or adjusted under 35 U.S.C. 154(b) by 466 days.

(21) Appl. No.: 12/476,444

(22) Filed: Jun. 2, 2009

(65) Prior Publication Data

US 2009/0295842 A1 Dec. 3, 2009

(30) Foreign Application Priority Data

Jun. 3, 2008 (JP) ..... 2008-146177

(51) Int. Cl.
*G09G 3/36* (2006.01)
*G09G 5/00* (2006.01)

(52) U.S. Cl.
USPC ..... 345/102; 345/690

(58) Field of Classification Search
USPC ..... 345/102, 690
See application file for complete search history.

(56) References Cited

U.S. PATENT DOCUMENTS

| | | | | |
|---|---|---|---|---|
| 7,154,561 | B2 * | 12/2006 | Jeong | 345/589 |
| 8,139,021 | B2 * | 3/2012 | Botzas et al. | 345/102 |
| 2003/0128299 | A1 * | 7/2003 | Coleman et al. | 348/674 |
| 2004/0051717 | A1 * | 3/2004 | Naiki | 345/596 |
| 2006/0146003 | A1 * | 7/2006 | Diefenbaugh et al. | 345/102 |
| 2006/0208998 | A1 * | 9/2006 | Okishiro et al. | 345/102 |
| 2009/0015601 | A1 * | 1/2009 | Kim | 345/690 |
| 2009/0284457 | A1 * | 11/2009 | Botzas et al. | 345/102 |

FOREIGN PATENT DOCUMENTS

JP 11-187290 7/1999

* cited by examiner

*Primary Examiner* — Adam J Snyder
(74) *Attorney, Agent, or Firm* — Fish & Richardson P.C.

(57) ABSTRACT

A liquid crystal display control circuit includes a current reduction rate setting circuit analyzes original gradations of pixels in an input image signal and sets a current reduction rate; a light emitting element control circuit adjusts a drive current of the light emitting element in response to the current reduction rate; a gradation changing circuit generates a display image signal in which the original gradations are changed to the display gradations; and a liquid crystal panel control circuit sets a transmittance of the liquid crystal panel in response to the display gradations of pixels included in the image display signal.

15 Claims, 4 Drawing Sheets

| | SUM OF FREQUENCIES x | RATIO TO ALL PIXELS | CURRENT REDUCTION RATE Pd | | | |
|---|---|---|---|---|---|---|
| | | | (i) | (ii) | (iii) | (iv) |
| 1 | x<4096 | ~0.7% | 60% | 60% | 60% | 60% |
| 2 | 4096≦x<8192 | ~1.3% | 60% | 60% | 60% | 55% |
| 3 | 8192≦x<16384 | ~2.7% | 55% | 55% | 55% | 50% |
| 4 | 16384≦x<24576 | ~5.3% | 55% | 50% | 50% | 40% |
| 5 | 24576≦x<32768 | ~10.7% | 50% | 50% | 45% | 35% |
| 6 | 32768≦x<65536 | ~21.3% | 50% | 45% | 40% | 30% |
| 7 | 65536≦x<131072 | ~32.0% | 45% | 40% | 35% | 25% |
| 8 | 131072≦x<262144 | ~47.7% | 40% | 35% | 30% | 20% |
| 9 | 262144≦x<524288 | ~85.3% | 35% | 30% | 25% | 15% |
| 10 | 524288≦x | ~100% | 30% | 25% | 20% | 0% |

| v=y \ h=x | 00 | 01 | 10 | 11 |
|---|---|---|---|---|
| 00 | 0 | 8 | 2 | 10 |
| 01 | 12 | 4 | 14 | 6 |
| 10 | 3 | 11 | 1 | 9 |
| 11 | 15 | 7 | 13 | 5 |

LIQUID CRYSTAL DISPLAY DEVICE CONTROL CIRCUIT AND LIQUID CRYSTAL DISPLAY SYSTEM, WHICH ADJUST BRIGHTNESS OF DISPLAY IMAGE BY USING HEIGHT DISTRIBUTION OF GRADATIONS OF INPUT IMAGE

CROSS REFERENCE TO RELATED APPLICATIONS AND INCORPORATION BY REFERENCE

This application is based upon and claims the benefit of priority from prior Japanese Patent Application P2008-146177 filed on Jun. 3, 2008; the entire contents of which are incorporated by reference herein.

BACKGROUND OF THE INVENTION

1. Field of the Invention

The present invention relates to a control technology for a liquid crystal display device, and particularly to a liquid crystal display device control circuit and a liquid crystal display system, which control display on a liquid crystal display device including a liquid crystal panel and a backlight.

2. Description of the Related Art

A liquid crystal display device using a liquid crystal panel is used for a cellular phone, a video camera and the like. A transmittance of liquid crystal is changed per pixel by applying a voltage thereto while emitting light from a backlight to be incident onto a liquid crystal panel, whereby the liquid crystal panel displays an image.

A power consumption of the liquid crystal display device including the liquid crystal panel largely depends on a power consumption by a drive current of the backlight. Therefore, a method is proposed, which adjusts brightness of the backlight in response to a battery residual amount, and reduces the power consumption of the backlight.

However, when the brightness of the backlight is lowered by reducing the drive current and so on, then brightness of the image displayed on the liquid crystal panel is lowered and a screen of the liquid crystal panel darkens though the power consumption of the liquid crystal display device can be reduced.

SUMMARY OF THE INVENTION

An aspect of the present invention is a liquid crystal display control circuit that controls a liquid crystal display device including a liquid crystal panel and a light emitting element that emits light to the liquid crystal panel. The liquid crystal display control circuit comprises a current reduction rate setting circuit configured to analyze original gradations of pixels included in an input image signal, and set a current reduction rate in response to a height distribution of the original gradations; a light emitting element control circuit configured to adjust a magnitude of a drive current of the light emitting element in response to the current reduction rate; a gradation changing circuit configured to change the original gradations in response to the current reduction rate to thereby set display gradations, and generate a display image signal in which the original gradations of the input image signal are changed to the display gradations; and a liquid crystal panel control circuit configured to set a transmittance of the liquid crystal panel in response to the display gradations of pixels included in the image display signal.

Another aspect of the present invention is a liquid crystal display system. The system comprises a liquid crystal display device including a liquid crystal panel and a light emitting element configured to emit light to the liquid crystal panel, and a liquid crystal display device control circuit. The liquid crystal display device control circuit includes a current reduction rate setting circuit configured to analyze original gradations of pixels included in an input image signal, and set a current reduction rate in response to a height distribution of the original gradations, a light emitting element control circuit configured to adjust a magnitude of a drive current of the light emitting element in response to the current reduction rate, a gradation changing circuit configured to change the original gradations in response to the current reduction rate to thereby set display gradations, and generate a display image signal in which the original gradations of the input image signal are changed to the display gradations, and a liquid crystal panel control circuit configured to set a transmittance of the liquid crystal panel in response to the display gradations of pixels included in the image display signal.

DETAILED DESCRIPTION OF THE INVENTION

Figure 1:
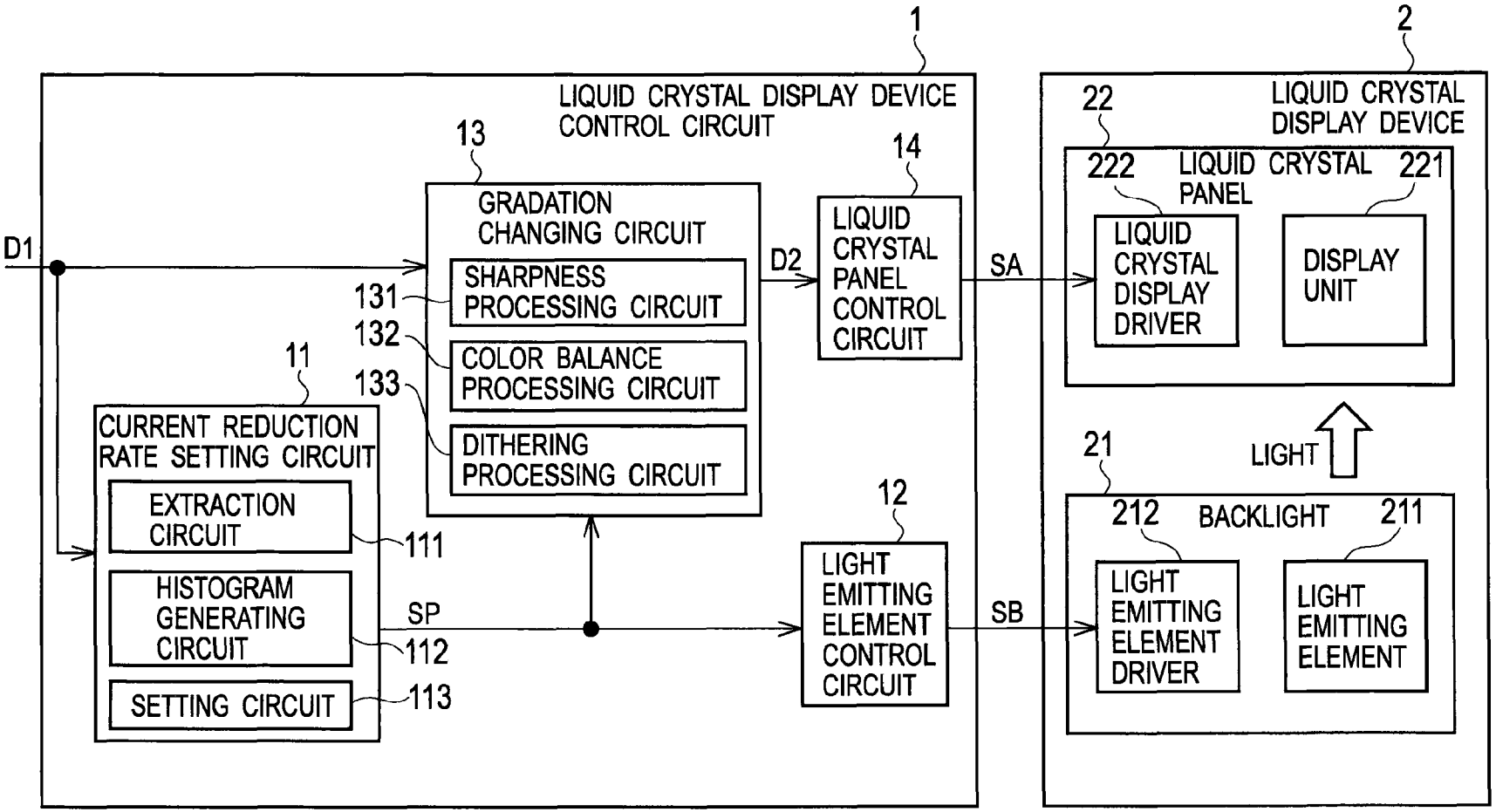
FIG. 1 is schematic diagram showing a configuration of a liquid crystal display system according to an embodiment of the present invention.

An embodiment of the present invention will be described with reference to the accompanying drawings. In the following description of the drawings, the same or similar reference numerals are applied to the same or similar parts and elements. The following embodiment just shows devices and methods to embody the technical idea of the present invention, and the technical idea of the present invention does not specify structures and arrangements of the constituent components and the like to the following description. The technical idea of the present invention can be variously modified in the scope of claims.

As shown in FIG. 1, a liquid crystal display device control circuit 1 according to an embodiment of the present invention controls a liquid crystal display device 2 including a liquid crystal panel 22 and a light emitting element 211 that emits light to the liquid crystal panel 22. In order to display image data inputted by an input image signal D1, the liquid crystal display device control circuit 1 controls the liquid crystal display device 2 while performing image processing for the input image signal D1.

The liquid crystal panel 22 includes a display unit 221 and a liquid crystal display driver 222 that controls the display unit 221. In general, the liquid crystal panel 22 has a structure in which a special liquid is sealed between two glass plates, changes an orientation of the liquid crystal molecules by applying a voltage thereto, and varies a light transmittance of the liquid crystal panel 22 itself, thereby displays an image. The liquid crystal display driver 222 controls the transmittance of such liquid crystal of the display unit 221 per display pixel in response to an image display control signal SA inputted from the liquid crystal display device control circuit 1 to the liquid crystal panel 22, and allows the display unit 221 to display an image.

Since the liquid crystal panel 22 itself does not emit the light, the liquid crystal panel 22 uses, as a light source, a backlight 21 including the light emitting element 211. The backlight 21 further includes a light emitting element driver 212 that adjusts a drive current amount of the light emitting element 211. For the light emitting element 211, for example, a light emitting diode (LED) and the like are adoptable. The light emitting element driver 212 adjusts the drive current amount of the light emitting element 211 in response to a drive current control signal SB inputted from the liquid crystal display device control circuit 1 to the backlight 21. As a result, brightness of emission light emitted from the backlight 21 to the liquid crystal panel 22 is controlled.

Image data of an image (hereinafter, referred to as an "original image") that has not still been subjected to the processing by the liquid crystal display device control circuit 1 is inputted to the liquid crystal display device control circuit 1 by the input image signal D1. As shown in FIG. 1, the input image signal D1 is inputted to a current reduction rate setting circuit 11 and a gradation changing circuit 13.

The liquid crystal display device control circuit 1 includes: the current reduction rate setting circuit 11 that analyzes original gradations of the pixels, which are included in the input image signal D1, and sets a current reduction rate in response to a height distribution of the original gradations in the input image signal D1; a light emitting element control circuit 12 that outputs, to the liquid crystal display device 2, the drive current control signal SB for adjusting the drive current amount of the light emitting element 211 in response to the current reduction rate; the gradation changing circuit 13 that changes the original gradations to set display gradations in response to the current reduction rate, and generates a display image signal D2 in which the original gradations of the input image signal D1 are changed to the display gradations; and a liquid crystal panel control circuit 14 that sets the transmittance of the liquid crystal panel 22 in response to the display gradations of the pixels, which are included in the display image signal D2. Here, the "original gradations" are gradations of the respective pixels, which are included in the input image signal D1, and are gradations of pixels of the original image.

A description will be made below of functions of the liquid crystal display device control circuit 1. Here, the description will be made of the case where the input image signal D1 is an RGB signal. It is assumed that the liquid crystal panel 22 is a normally black panel in which a transmittance is set higher as gradations of an image displayed thereon are higher. Hereinafter, the image displayed on the liquid crystal panel 22 is referred to as a "display image". Specifically, as a pixel of the display image on the liquid crystal panel 22 is more approximate to white, a transmittance of the pixel is set higher.

The current reduction rate setting circuit 11 includes an extraction circuit 111, a histogram generating circuit 112 and a setting circuit 113. The extraction circuit 111 extracts the original gradations of the respective pixels, which are included in the input image signal D1, individually. The histogram generating circuit 112 calculates frequencies of the original gradations for the input image signal D1 and generates the histogram of the original gradations. The setting circuit 113 sets the current reduction rate for the input image signal D1 in response to a histogram distribution of the original gradations.

More specifically, the extraction circuit 111 extracts the original gradations of the respective pixels, which are included in image data equivalent to one frame of the original image, the image data being inputted by the input image signal D1, and then generates gradation data for generating a histogram. For example, in the case where the gradations are set for each of red (R), green (G) and blue (B) in the data of each of the pixels, which is included in the input image signal D1, the highest gradations among the gradations of the respective colors are defined as gradations of the pixel concerned, and gradation data composed of the gradations of the respective pixels is generated.

Besides such a method of defining the highest gradations among the gradations of the respective colors as the gradations of the related pixel, other methods of defining the gradations of each of the pixels can be adopted. For example, the gradations of each pixel may be defined by assigning weights to the respective gradations of R, G and B of each pixel. Specifically, such a method is adoptable, in which, since blue is a conspicuous color, the weight assigned to blue is made smaller than the weights assigned to green and red, and the weights are assigned to the respective gradations of R, G and B in a ratio of 3:3:2. Alternatively, the weights may be assigned to the respective gradations of R, G and B of each pixel in consideration for the respective luminance components of R, G and B.

Figures 2, 3:
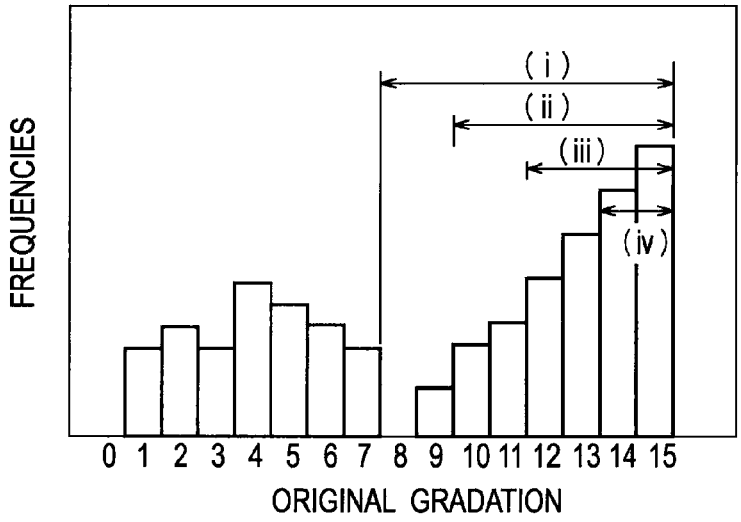
FIG. 2 shows an example of a histogram of original gradations generated by a liquid crystal display device control circuit according to the embodiment of the present invention.
FIG. 3 shows an example of a table of current reduction rates, which is used by the liquid crystal display device control circuit according to the embodiment of the present invention.

The histogram generating circuit 112 calculates the frequencies of the original gradations by using the gradation data generated by the extraction circuit 111, and generates the histogram of the original gradations equivalent to one frame. Note that, in the case where the gradations of each pixel, which are included in the input image signal D1, are set, for example, from 0 to 255 gradations for each of R, G and B, if the histogram is generated by classifying the original gradations into 256 levels, then a circuit scale is increased. Therefore, for example as shown in FIG. 2, the histogram of the original gradations may be generated by classifying the original gradations into 16 levels from zero to 15. FIG. 2 shows an example of generating the histogram of the original gradations by using higher-order four bits on the high gradation side for each of R, G and B of the input image signal D1. Such classification of the original gradations is not limited to 16 levels, and it is a matter of course that the number of levels can be set as appropriate.

In usual, in the case where the input image signal D1 is a data signal of a visually dark image including many pixels with low gradations, a histogram of a distribution in which lower original gradations are many is generated. On the contrary, in the case where the input image signal D1 is a data signal of a visually bright image including many pixels with higher gradations, a histogram of a distribution in which higher original gradations are many is generated.

The setting circuit 113 sets the current reduction rate of the light emitting element 211 based on the distribution of the histogram of the original gradations, which is generated by the histogram generating circuit 112. Specifically, the current reduction rate of the light emitting element 211 is set by using a current reduction rate table, for example, as shown in FIG. 3. The current reduction rate table is a table that defines current reduction rates Pd of the light emitting element 211 based on the histogram of the original gradations. The current reduction rate table illustrated in FIG. 3 is a table in which the current reduction rates Pd are set so as to correspond to the histogram of the original gradations, which is shown in FIG. 2.

The current reduction rates Pd of the current reduction rate table are set based on a visual difference between the original image and the display image. For example, the display image and the original image are compared with each other for each of the plurality of current reduction rates Pd, and the current reduction rate Pd is selected. Specifically, the display image and the original image are compared with each other for each of the cases where the drive current of the light emitting element 211 is reduced by a variety of the current reduction rates Pd, and the current reduction rate Pd at which an appearance difference between the original image and the display image, that is, the visual difference therebetween is small is selected. The current reduction rate Pd of the current reduction rate table is set depending on to which extent the visual difference between the original image and the display image is permitted. In short, the current reduction rate Pd is set larger as the permitted visual difference is larger.

In the current reduction rate table of FIG. 3, the respective sections (i), (ii), (iii) and (iv) of the "current reduction rate Pd" are current reduction rates Pd for the sums x of the frequencies for higher-order eight levels, six levels, four levels and two levels in the histogram of the original gradations, respectively (refer to FIG. 2). As shown in FIG. 3, the current reduction rates Pd are smaller as the number of pixels with high gradations is larger.

As the current reduction rate Pd of the light emitting element 211, for example, the lowest value among current reduction rates Pd1 to Pd4 of the respective sections (i), (ii), (iii) and (iv) is adopted. If the case where the sum x of the frequencies is $32768 \leq x < 65536$ is taken as an example (section "6" of FIG. 3), then the current reduction rate Pd1 of the section (i) is 50%, the current reduction rate Pd2 of the section (ii) is 45%, the current reduction rate Pd3 of the section (iii) is 40%, and the current reduction rate Pd4 of the section (iv) is 30%. In this case, Pd4=30%, which is the smallest among the current reduction rates Pd1 to Pd4, is adopted as the current reduction rate Pd of the light emitting element 211.

An influence of luminance lowering of the backlight 21, which is caused by the drive current reduction of the light emitting element 211, on the display image is larger as the gradations are higher. Therefore, the current reduction rate Pd4 of the section (iv) may be adopted as the current reduction rate Pd of the light emitting element 211 without comparing the current reduction rates Pd1 to Pd4 with one another.

As described above, the setting circuit 113 sets the current reduction rate Pd based on the distribution of the histogram of the original gradations. Specifically, in the case where the input image signal D1 includes the large number of pixels with high gradations, the current reduction rate Pd is set low in order to highly maintain the luminance of the light emitting element 211. This is because the visual difference between the original image and the display image on the liquid crystal display device 2, which is caused by the reduction of the luminance of the emission light from the backlight 21, is large. Meanwhile, in the case where the input image signal D1 includes a large number of pixels with low gradations, the visual difference between the original image and the display image is not conspicuous even if the luminance of the emission light from the backlight 21 is lowered. Therefore, in the case of such a distribution in which the number of low gradations is large in the histogram of the original gradations, the current reduction rate Pd is set high.

The current reduction rate setting circuit 11 transmits the set current reduction rate Pd to the light emitting element control circuit 12 and the gradation changing circuit 13 by a current reduction rate signal SP.

Incidentally, in the case where the luminance of the light emitting element 211 changes radically, flickering occurs on a screen displayed on the liquid crystal panel 22. In order to suppress the occurrence of the flickering, the setting circuit 113 has a dimming function to gradually change the luminance of the light emitting element 211 in synchronization with switching of the display image. The "dimming function" is a function to set the current reduction rate Pd of the light emitting element 211 for each frame so as not to cause the flickering on the display screen owing to a luminance difference among the frames at the time of such frame switching. For example, the current reduction rate Pd of each frame is set so that a difference of the current reduction rates Pd of the light emitting element 211 among continuous frames can be approximately 0.5% to 1%.

Figure 4:
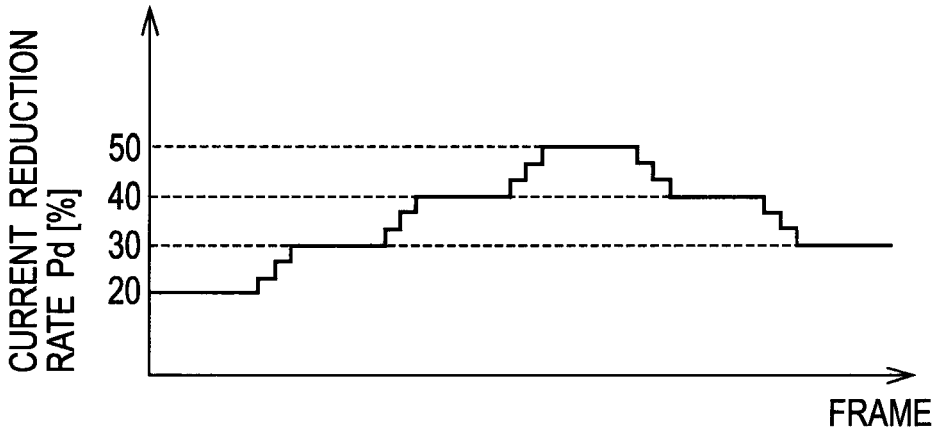
FIG. 4 shows an example of current reduction rates set by dithering processing of the liquid crystal display device control circuit according to the embodiment of the present invention.

Specifically, the setting circuit 113 gradually changes the current reduction rates Pd of the respective frames so that the drive current of the light emitting element 211 cannot change radically in the case where the current reduction rates Pd among the frames are different from one another, that is, for example as shown in FIG. 4, so that the drive current can gradually change while frames with small luminance differences are continuing with one another. Then, the current reduction rates Pd thus set are transmitted to the light emitting element control circuit 12 and the gradation changing circuit 13. In other words, the luminance of the light emitting element 211 changes gradually while a plurality of the frames among which differences of the input gradations are small are being displayed continuously on the liquid crystal panel 22.

In response to the inputted current reduction rate signal SP, the light emitting element control circuit 12 outputs the drive current control signal SB for adjusting the magnitude of the drive current of the light emitting element 211 at the current reduction rate Pd to the light emitting element driver 212 of the liquid crystal display device 2. For example, the light emitting element control circuit 12 performs a pulse width modulation (PWM) control for the light emitting element driver 212 by the drive current control signal SB as a pulse signal in which a duty amount is set in response to the current reduction rate Pd of the drive current of the light emitting element 211. The PWM control for setting the duty amount is performed so as to gradually change the current reduction rate Pd of the drive current by the dimming function, whereby the occurrence of the flickering of the display image is suppressed.

In accordance with the drive current control signal SB, the light emitting element driver 212 adjusts the magnitude of the drive current of the light emitting element 211 by using the current reduction rate Pd. As a result, the drive current of the light emitting element 211 is reduced, and the luminance of the emission light from the backlight 21 to the liquid crystal panel 22 is lowered. As a result, the power consumption of the liquid crystal display device 2 is reduced.

The gradation changing circuit 13 sets the display gradations by increasing the respective original gradations in response to the current reduction rate Pd so as to compensate such luminance lowering of the emission light of the backlight 21, which is caused by the reduction of the drive current of the light emitting element 211. At this time, the gradation changing circuit 13 may correct the original gradations by using a correction value set based on the difference between the display image of the liquid crystal display device 2 and the original image, and may set the display gradations. This correction value is preset in the case of correcting display characteristics of the liquid crystal panel 22, in the case of displaying an image with a desired color tone, which is different from the original image, on the liquid crystal panel 22, and in the like. An example of setting the display gradations will be shown below.

When the transmittance of the liquid crystal of the display unit 221 is Tλ, and the luminance of the emission light of the backlight 21 is $I_o$, then a luminance I of transmission light outputted from the liquid crystal panel 22 is generally represented by the following Equation (1):

$$I=T\lambda\times I_o \tag{1}$$

The transmittance Tλ is controlled by the liquid crystal display driver 222, and the luminance $I_o$ of the emission light is controlled by the light emitting element driver 212. Here, when the luminance I of the transmission light is represented by using the original gradation $L_{IN}$, the display gradation $L_{OUT}$ and the current reduction rate Pd, then the luminance I is represented as in the following Equation (2):

$$I=L_{IN}\times I_o=L_{OUT}\times Pd\times I_o \tag{2}$$

Hence, the display gradation $L_{OUT}$ can be set as in the following Equation (3):

$$L_{OUT}=1/Pd\times L_{IN} \tag{3}$$

Figure 5:
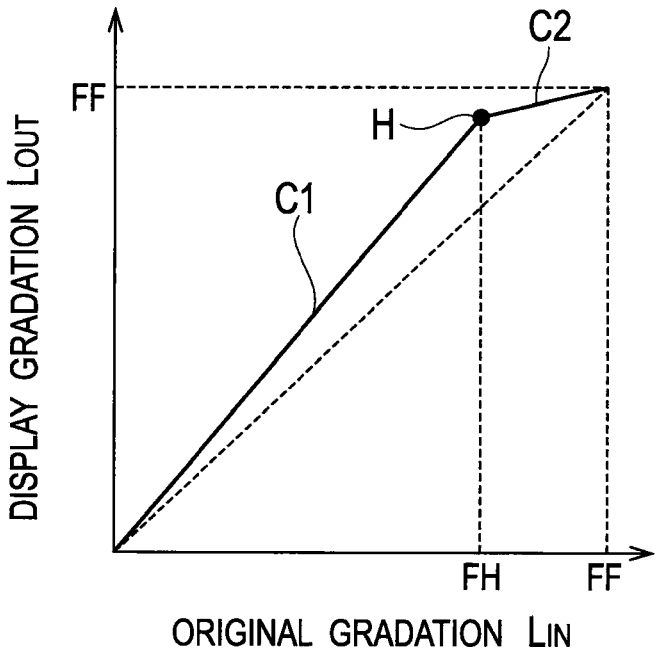
FIG. 5 shows an example of changing characteristics defining a relationship between the original gradations and display gradations, which is set by the liquid crystal display device control circuit according to the embodiment of the present invention.

Note that, in the case of calculating the display gradation $L_{OUT}$ by using Equation (3), it is possible that the display gradation $L_{OUT}$ calculated for the original gradation $L_{IN}$ in a high range may become larger than the maximum settable gradation FF. In this case, if the display gradation $L_{OUT}$ larger than the maximum gradation FF in terms of a calculated value is set as the maximum gradation FF, then there occurs a problem that the display gradations $L_{OUT}$ of the original gradations $L_{IN}$ with a certain value or more entirely become the maximum gradation FF, resulting in that regions in which the luminance of the display image is high are displayed to be uniformly white. In order to avoid this problem, as shown in FIG. 5, the gradation changing circuit 13 has an increasing rate modulation function to change an increasing rate of the display gradation $L_{OUT}$ with respect to the original gradation $L_{IN}$ before and after a change point H.

Specifically, in the case where the original gradation $L_{IN}$ is lower than a gradation FH at the change point H, the display gradation $L_{OUT}$ is set by changing characteristics C1 which define a relationship between the original gradation $L_{IN}$ and the display gradation $L_{OUT}$, which is obtained by Equation (3). Then, in a range where the original gradation $L_{IN}$ is the gradation FH or higher, the display gradation $L_{OUT}$ is set in accordance with changing characteristics C2. As shown in FIG. 5, in accordance with the changing characteristics C2, the increasing rate of the display gradation $L_{OUT}$ with respect to the original gradation $L_{IN}$ is set smaller than the increasing rate according to the changing characteristics C1. The changing characteristics C2 have a fixed increasing rate regardless of a value of the display gradation $L_{OUT}$ calculated by the Equation (3), and are set so that the display gradation $L_{OUT}$ can become the maximum gradation FF when the original gradation $L_{IN}$ is the maximum gradation FF. With regard to an increasing rate of the changing characteristics C2, for example, the increased number of the display gradation $L_{OUT}$ is set at one with respect to the increased number two of the original gradation $L_{IN}$. Alternatively, the increasing rate of the changing characteristics C2 may be set under a condition where the increased number of the display gradation $L_{OUT}$ is set at 1 with respect to the increased number four or eight of the original gradation $L_{IN}$.

As described above, the gradation changing circuit 13 sets the display gradation $L_{OUT}$ in accordance with the changing characteristics C1 in the case where the original gradation $L_{IN}$ is lower than the gradation FH, and sets the display gradation $L_{OUT}$ in accordance with the changing characteristics C2 in the case where the original gradation $L_{IN}$ is the gradation FH or higher. As a result, in accordance with the gradation changing circuit 13, the problem that the regions in which the luminance of the display image is high are displayed to be uniformly white can be avoided.

The change point H is set in response to the increasing rate of the changing characteristics C1 and the increasing rate of the changing characteristics C2. As the gradation FH is set at a lower gradation, a region in which a gradation difference in the original image can be reproduced is reduced; however, such a problem that a bright region of the display image becomes flat can be avoided. Meanwhile, as the gradation FH is set at a higher gradation, a gradation difference in the high gradation range becomes smaller, and the bright region of the display image becomes prone to look flatter; however, the gradation difference in the original image can be reproduced over the wide original gradation $L_{IN}$. Therefore, it is desirable to set the gradation FH in response to desired image quality of the display image.

As described above, the gradation changing circuit 13 sets the display gradation $L_{OUT}$ for each original gradation $L_{IN}$ in response to the current reduction rate Pd. Then, the gradation changing circuit 13 generates the display image signal D2 of the RGB signal from the input image signal D1 by replacing the original gradation $L_{IN}$ with the set display gradation $L_{OUT}$.

Figures 6, 7:
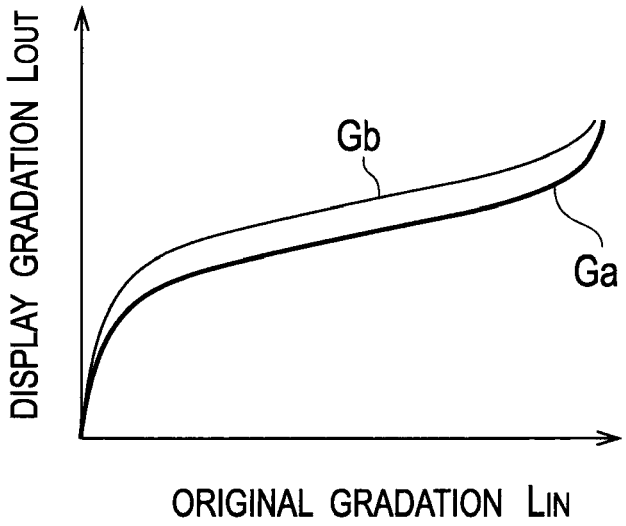
FIG. 6 shows an example of gamma characteristics for use in image processing.
FIG. 7 shows an example of a Bayer table for use in the image processing.

Incidentally, there is a method for generating the display image signal D2 from the input image signal D1 by using gamma characteristics changed in response to the current reduction rate Pd calculated from the input image signal D1. For example, this is a method of setting the display gradation $L_{OUT}$ in such a manner that the original gradation $L_{IN}$ is changed by using gamma characteristics Gb obtaining by changing gamma characteristics Ga as shown in FIG. 6 so as to set the display gradation $L_{OUT}$ in response to the current reduction rate Pd. Here, the gamma characteristics Ga are gamma characteristics of the case of displaying the original image on the liquid crystal panel 22 without reducing the drive current of the light emitting element 211.

In the method for generating the image display signal D2 by using the gamma characteristics Gb, as shown in FIG. 6, there is a case where the gradation difference between the original gradation $L_{IN}$ and the display gradation $L_{OUT}$ becomes large in a low gradation range. In this case, a difference between black and gray in the display gradation $L_{OUT}$, or the like becomes larger than that in the original gradation $L_{IN}$. As a result, there occurs a problem that a phenomenon occurs, in which a chromatic difference between a black region displayed on the liquid crystal display device 2 and a gray region displayed thereon is displayed to be larger than in the original image.

However, the gradation changing circuit 13 sets the display gradation $L_{OUT}$ by using the changing characteristics C1 or the changing characteristics C2, which is linear as shown in FIG. 5 and is defined in consideration for the current reduction rate Pd and the correction value such as the gamma characteristic value. Therefore, the gradation difference between the original gradation $L_{IN}$ and the display gradation $L_{OUT}$ is small in the low gradation range. In short, the phenomenon, in which the chromatic difference between the black region displayed on the liquid crystal display device and the gray region displayed thereon is displayed to be larger than in the original image, does not occur in the liquid crystal display device control circuit 1 shown in FIG. 1.

Moreover, the gradation changing circuit 13 has a function to correct the set display gradation $L_{OUT}$ in order to far more visually approximate the display image of the liquid crystal display device 2 to the original image. Therefore, the gradation changing circuit 13 includes a sharpness processing circuit 131, a color balance processing circuit 132 and a dithering processing circuit 133, which are shown in FIG. 1.

For each pixel included in the display image signal D2, which is taken as a subject pixel, the sharpness processing circuit 131 calculates a difference thereof in display gradation $L_{OUT}$ from an adjacent pixel adjacent thereto. Then, in the case where the calculated difference in display gradation $L_{OUT}$ is a preset sharpness determination value or more, the sharpness processing circuit 131 performs sharpness processing for the subject pixel taken as a sharpness correction subject pixel. Specifically, the sharpness processing circuit 131 changes the display gradation of the sharpness correction subject pixel so that the difference in display gradation $L_{OUT}$ between the sharpness correction subject pixel and the adjacent pixel, which is adjacent to the sharpness correction subject pixel, can become larger.

For example, in the case where a major region of the original image is dark, and a partial region thereof is bright, then the histogram of the original gradation $L_{IN}$ has a distribution in which the low gradations are many. In this case, since the current reduction rate Pd is set large, the display gradation $L_{OUT}$ in the high gradation range is set, for example, in accordance with the changing characteristics C2 shown in FIG. 5, whereby the difference in display gradation $L_{OUT}$ in the bright region of the original image is small. As a result, if the image is displayed on the liquid crystal display device 2 by directly using the display gradation $L_{OUT}$ set based on the current reduction rate Pd, then a phenomenon in which a white region looks flat occurs on the display image.

As described above, in the case where the visual difference between the original image and the display image is large, which is caused by the fact that the gradation difference between the adjacent pixels is small particularly in the high gradation range, then the sharpness processing for emphasizing a fine shading of an outline of the display image is performed, whereby the visual difference between the original image and the display image can be reduced. The sharpness processing circuit 131 performs the sharpness processing for the sharpness correction subject pixels, in each of which the difference in display gradation $L_{OUT}$ from the adjacent pixel is the sharpness determination value or more, among the pixels included in the display image signal D2. Though being arbitrarily settable, the sharpness determination value is set so that the visual difference between the original image and the display image on the liquid crystal display device 2 can become small. By the sharpness processing as described above, the difference in display gradation $L_{OUT}$ becomes larger in the case where the difference in display gradation $L_{OUT}$ between the adjacent pixels is a certain value or more, and the shading of the outline can be emphasized.

In the case of determining whether or not to perform the sharpness processing for each pixel, for example, a pixel displayed immediately before such a determination subject pixel just needs to be defined as the pixel adjacent to the determination subject pixel. Alternatively, in the case where the liquid crystal display device control circuit 1 includes a one-line random access memory (one-line RAM) that latches display pixel data, and the like, whether or not to perform the sharpness processing may be determined while including a pixel that is adjacent to the determination subject pixel and is included in a pixel string displayed immediately before the determination subject pixel. In the case where there are a plurality of the adjacent pixels, for example, a mean value among the determination subject pixel and the pixels adjacent to the determination subject pixel is calculated. Then, in the case where a difference in display gradation $L_{OUT}$ between the mean value and the determination subject pixel is the sharpness determination value or more, the determination subject pixel concerned is defined as the sharpness correction subject pixel. Hereinafter, the display gradation $L_{OUT}$ of the adjacent pixel or the mean value of the display gradations $L_{OUT}$ of the adjacent pixels is referred to as a "comparison gradation".

For example, the sharpness processing is executed in the following manner. In the case where the display gradation $L_{OUT}$ of the sharpness correction subject pixel is higher than the comparison gradation, a fixed gradation changing amount dL is added to the display gradation $L_{OUT}$ of the correction subject pixel. Meanwhile, in the case where the display gradation $L_{OUT}$ of the sharpness correction subject pixel is lower than the comparison gradation, the gradation changing amount dL is subtracted from the display gradation $L_{OUT}$ of the sharpness correction subject pixel. Though being arbitrarily settable, for example, the gradation changing amount dL is set at ¼ of the difference between the display gradation $L_{OUT}$ of the sharpness correction subject pixel and the comparison gradation.

In response to the display characteristics of the liquid crystal panel 22, and the like, the color balance processing circuit 132 changes the display gradation $L_{OUT}$ so as to display the display image on the liquid crystal panel 22 in the predetermined color tone. For example, the color balance processing circuit 132 changes the display gradation $L_{OUT}$ of each pixel in such a manner that the display gradation $L_{OUT}$ is varied by such changing values set by using the display gradation $L_{OUT}$ of the pixel concerned. The following Equation (4) shows an example of a method of calculating a display gradation $R_{DISP}$ of R, which has been already subjected to color balance processing, by using a display gradation $R_{SHARP}$ of R in the display image signal D2, which has been already subjected to the sharpness processing, and using changing values set by multiplying original gradations $R_{ORG}$, $G_{ORG}$ and $B_{ORG}$ by a fixed ratio:

$$R_{DISP}=R_{SHARP}+R_{ORG}/16-G_{ORG}/32-B_{ORG}/32 \quad (4)$$

The display gradations of B and G in the display image signal D2 can also be changed in a similar way to the display gradation of R. The changing values of the display gradations by the color balance processing are arbitrarily settable. It is preferable to set the changing values of the display gradation and whether or not to perform the color balance processing in response to the display characteristics of the liquid crystal panel 22.

By the color balance processing, chromatic monotonization owing to the lowering of the luminance, which is caused by reducing the drive current of the light emitting element 211, is lessened, and a vivid image can be displayed on the liquid crystal panel 22.

The dithering processing circuit 133 performs dithering processing for improving smoothness of the gradations of the display image, which is lost by the reduction of the number of gradations of the display gradation $L_{OUT}$, by generating intermediate gradations of the display gradation $L_{OUT}$ in a pseudo manner. For example, in the case where the display gradation $L_{OUT}$ is set by using the changing characteristics C2 with a fixed increasing rate for the pixel in the bright region of the original image, the difference in display gradation $L_{OUT}$ between the adjacent pixels becomes small. Specifically, in the high gradation range of the display image signal D2, in some case, a gradation difference in which the gradation difference in the original image is reproduced with high fidelity cannot be obtained, and the smoothness of the gradations of the display image is lost. The dithering processing is effective in such a case. The dithering processing circuit 133 changes a value of a Bayer table for a pixel, in which the display gradation $L_{OUT}$ is a first dithering determination value or more, among the respective pixels included in the display image signal D2, or for a pixel thereamong, in which the difference in display gradation $L_{OUT}$ from the adjacent pixel is smaller than a second dithering determination value.

Specifically, the dithering processing circuit 133 first defines, as a determination subject pixel, each pixel included in the image display signal D2 already subjected to the sharpness processing, and determines whether or not to perform the dithering processing for the determination subject pixel.

For such determination, the dithering processing circuit 133 calculates a mean value of the display gradations $L_{OUT}$ of the determination subject pixel and the adjacent pixel adjacent thereto. As this adjacent pixel, such a pixel that is adjacent to the determination subject pixel and is displayed immediately before the determination subject pixel is selectable in a similar way to the case of determining whether or not to perform the sharpness processing. Hence, it may be determined whether or not to perform the dithering processing for the determination subject pixel by using the comparison gradation calculated in the sharpness processing. A description will be illustratively made below of the case of performing the dithering processing by using the above-mentioned comparison gradation.

In the case where the comparison gradation is larger than the preset first dithering determination value, the dithering processing is performed for the determination subject pixel. Specifically, a pixel in a range in which the display gradation $L_{OUT}$ is larger than the set value, that is, in the high gradation range is defined as a subject of the dithering processing. This is because, as already mentioned, it is frequent that the gradation difference in which the gradation difference in the original image is reproduced with high fidelity cannot be obtained in the high gradation range.

Moreover, in the case where the difference between the display gradation $L_{OUT}$ of the determination subject pixel and the comparison gradation is smaller than the preset second dithering determination value, the dithering processing is performed for the determination subject pixel. Specifically, in the case where the difference in display gradation $L_{OUT}$ between the determination subject pixel and the pixel adjacent thereto is smaller than the set value, the determination subject pixel is defied as the subject of the dithering processing. The dithering processing is performed in the range where the difference in display gradation $L_{OUT}$ between the pixels is small, whereby the gradations of the whole of the display image are smoothened.

Though being arbitrarily settable, the first dithering determination value and the second dithering determination value are set in consideration for the display characteristics of the liquid crystal panel 22 so that the visual difference between the original image and the display image can be resolved, and that the gradations of the display screen can be displayed smoothly.

The dithering processing is executed by changing the value of the Bayer table that is as shown, for example, in FIG. 7 and is prepared for the display image. The Bayer table shown in FIG. 7 is an example of a Bayer table having 4×4 sections in which each of a horizontal (h=x) direction and vertical (v=y) direction of the display screen is divided into four. The dithering processing circuit 133 subtracts a preset value, for example, ¼ of a value of the Bayer table for a section thereof corresponding to the pixel as the dithering processing subject from a value for the section concerned, and thereby sets a new Bayer table. The value subtracted from the value of the Bayer table is arbitrarily settable, and a value at which a desired gradation is displayed is set. Note that a value of the Bayer table, which becomes negative by such subtraction as described above, is set at "0".

By performing the dithering processing as described above, noise is added to the display image to thereby diffuse gradation components, and the visual difference between the original image and the display image is reduced. The dithering processing is effective for the reduction of the visual difference particularly in the high gradation range.

Note that, in the case where the display gradation $L_{OUT}$ of the pixel, which is changed by the sharpness processing, the color balance processing or the dithering processing, becomes smaller than the settable minimum gradation, the changed display gradation $L_{OUT}$ the pixel is set as the minimum gradation. Meanwhile, in the case where the display gradation $L_{OUT}$ of the pixel, which is changed by any of the processing described above, becomes larger than the settable maximum gradation, the display gradation $L_{OUT}$ of the pixel is set as the maximum gradation.

By performing the sharpness processing, the color balance processing and the dithering processing, which are described above, the display image signal D2 for displaying the display image of which visual difference from the original image is small on the liquid crystal panel 22 can be generated. Each processing described above is effective for resolving unnaturalness inherent in how the display image looks in such a case of using, for example, the gamma characteristic value as the correction value. In particular, the sharpness processing and the dithering processing are effective for the case where the difference between the adjacent pixels in original gradation in the high gradation range is not reproduced in the display gradation.

The image display signal D2 generated in the gradation changing circuit 13 is transmitted to the liquid crystal panel control circuit 14. The liquid crystal panel control circuit 14 sets the transmittance of the liquid crystal panel 22 in response to the display gradations $L_{OUT}$ of the respective pixels included in the display image signal D2. In the case where the liquid crystal panel 22 is the normally black panel, the transmittance of the pixel is set higher as the display gradation $L_{OUT}$ of the pixel is higher. Data for the display image, in which the transmittance of each pixel is set, is outputted to the liquid crystal display driver 222 of the liquid crystal display device 2 by the image display control signal SA. The liquid crystal display driver 222 controls the transmittance of the liquid crystal of the display unit 221 per pixel in response to the image display control signal SA, and allows the display unit 221 to display the image. Alternatively, the transmittance of the display unit 221 is set in response to the display gradations $L_{OUT}$ of the respective pixels included in the image display control signal SA by the liquid crystal display driver 222.

As described above, in the liquid crystal display device control circuit 1 according to the embodiment of the present invention, the current reduction rate Pd of the drive current of the light emitting element 211 is adjusted in response to the height distribution of the gradations of the original image. Moreover, the original gradation $L_{IN}$ is changed in response to the current reduction rate Pd, whereby the display gradation $L_{OUT}$ is set, and the transmittance of the liquid crystal panel 22 is adjusted in response to the display gradation $L_{OUT}$. Hence, in accordance with the liquid crystal display device control circuit 1 shown in FIG. 1, the luminance of the emission light of the light emitting element 211 and the transmittance of the liquid crystal panel 22 in the next frame can be set from the gradation data equivalent to one frame, for example. The brightness of the display image displayed on the liquid crystal display device 2 corresponds to a product of the luminance of the emission light of the light emitting element 211 and the transmittance of the liquid crystal panel 22. Accordingly, in accordance with the liquid crystal display device control circuit 1 shown in FIG. 1, the image in which the luminance lowering of the emission light of the light emitting element 211 owing to the reduction of the drive current is compensated is displayed on the liquid crystal display device 2.

In general, a power consumption by the drive current for controlling the luminance of the emission light of the light emitting element 211 is larger than a power consumption required for controlling the transmittance of the liquid crystal panel 22. Therefore, by reducing the drive current, the power consumption of the whole of the liquid crystal display device 2 is reduced to a large extent. In short, in accordance with the liquid crystal display device control circuit 1 shown in FIG. 1, the power consumption of the liquid crystal display device 2 can be reduced, and the luminance of the display image can be suppressed from being lowered.

Moreover, by performing the sharpness processing, the color balance processing and the dithering processing, the visual difference between the display image displayed on the liquid crystal display device 2 and the original image can be made small. Furthermore, by the dimming function, the flickering of the display image can be suppressed from occurring.

Note that the current reduction rate Pd and display gradation of the frame to be displayed next may be decided by using the original gradation data equivalent to a plurality of the frames.

Various modifications will become possible for those skilled in the art after receiving the teachings of the present disclosure without departing from the scope thereof.

What is claimed is:

1. A liquid crystal display control circuit that controls a liquid crystal display device including a liquid crystal panel and a light emitting element that emits light to the liquid crystal panel, comprising:

a current reduction rate setting circuit configured to analyze original gradations of pixels included in an input image signal, and set a current reduction rate in response to a height distribution of the original gradations;

a light emitting element control circuit configured to adjust a magnitude of a drive current of the light emitting element in response to the current reduction rate;

a gradation changing circuit configured to change the original gradations in response to the current reduction rate to thereby set display gradations, and generate a display image signal in which the original gradations of the input image signal are changed to the display gradations; and a liquid crystal panel control circuit configured to set a transmittance of the liquid crystal panel in response to the display gradations of pixels included in the display image signal, wherein the current reduction rate setting circuit sets the current reduction rate so that a difference between the current reduction rates among continuous frames falls within a range of 0.5% to 1%, wherein the gradation changing circuit comprises:

a sharpness processing circuit configured to change the display gradation of a sharpness correction subject pixel included in the display image signal so that the difference in display gradation can become large, in a case where a difference in the display gradation between the sharpness correction subject pixel and a pixel adjacent to the sharpness correction subject pixel is a sharpness determination value or more; and a dithering processing circuit configured to perform dithering processing for the sharpness correction subject pixel subjected to the sharpness processing in the sharpness processing circuit, wherein the dithering processing circuit performs the dithering processing by using a comparison gradation calculated in the sharpness processing.

2. The circuit of claim 1, wherein the current reduction rate setting circuit comprises:

an extraction circuit configured to extract the original gradations of the pixels included in the input image signal;

a histogram generating circuit configured to calculate frequencies of the original gradations to thereby generate a histogram of the original gradations; and a setting circuit configured to set the current reduction rate in response to a distribution of the original gradations in the histogram.

3. The circuit of claim 2, wherein the setting circuit sets the current reduction rate to be smaller as the histogram has a distribution in which the number of high gradations is larger.

4. The circuit of claim 1, wherein the gradation changing circuit sets the display gradations by using a correction value set based on a difference between a display image displayed on the display device and the input image signal.

5. The circuit of claim 4, wherein the gradation changing circuit sets the display gradations in accordance with first changing characteristics which define a relationship between the original gradation and the display gradation if the original gradation is lower than a gradation at a predetermined change point, and sets the display gradations in accordance with second changing characteristics which are set smaller than the first changing characteristics if the original gradation is equal to or more than the gradation at the predetermined change point.

6. The circuit of claim 1, wherein the gradation changing circuit comprises a color balance processing circuit configured to change the display gradations of the pixels included in the display image signal by using values of the display gradations of the pixels.

7. The circuit of claim 1, wherein the dithering processing circuit changes a value of a Bayer table for a pixel, in which the display gradation is a first dithering determination value or more, among the respective pixels included in the display image signal, or for a pixel thereamong, in which the difference in display gradation from the adjacent pixel is smaller than a second dithering determination value.

8. A liquid crystal display system comprising:

a liquid crystal display device including a liquid crystal panel and a light emitting element configured to emit light to the liquid crystal panel; and a liquid crystal display device control circuit including a current reduction rate setting circuit configured to analyze original gradations of pixels included in an input image signal, and set a current reduction rate in response to a height distribution of the original gradations, a light emitting element control circuit configured to adjust a magnitude of a drive current of the light emitting element in response to the current reduction rate, a gradation changing circuit configured to change the original gradations in response to the current reduction rate to thereby set display gradations, and generate a display image signal in which the original gradations of the input image signal are changed to the display gradations, and a liquid crystal panel control circuit configured to set a transmittance of the liquid crystal panel in response to the display gradations of pixels included in the display image signal, wherein the current reduction rate setting circuit sets the current reduction rate so that a difference between the current reduction rates among continuous frames falls within a range of 0.5% to 1%, wherein the gradation changing circuit comprises:

a sharpness processing circuit configured to change the display gradation of a sharpness correction subject pixel included in the display image signal so that the difference in display gradation can become large, in a case where a difference in the display gradation between the sharpness correction subject pixel and a pixel adjacent to the sharpness correction subject pixel is a sharpness determination value or more; and a dithering processing circuit configured to perform dithering processing for the sharpness correction subject pixel subjected to the sharpness processing in the sharpness processing circuit, wherein the dithering processing circuit performs the dithering processing by using a comparison gradation calculated in the sharpness processing.

9. The system of claim 8, wherein the current reduction rate setting circuit comprises:

an extraction circuit configured to extract the original gradations of the pixels included in the input image signal;

a histogram generating circuit configured to calculate frequencies of the original gradations to thereby generate a histogram of the original gradations; and a setting circuit configured to set the current reduction rate in response to a distribution of the original gradations in the histogram.

10. The system of claim 9, wherein the setting circuit sets the current reduction rate to be smaller as the histogram has a distribution in which the number of high gradations is larger.

11. The system of claim 8, wherein the gradation changing circuit sets the display gradations by using a correction value set based on a difference between a display image displayed on the display device and the input image signal.

12. The system of claim 11, wherein the gradation changing circuit sets the display gradations in accordance with first changing characteristics which define a relationship between the original gradation and the display gradation if the original gradation is lower than a gradation at a predetermined change point, and sets the display gradations in accordance with second changing characteristics which are set smaller than the first changing characteristics if the original gradation is equal to or more than the gradation at the predetermined change point.

13. The system of claim 8, wherein the gradation changing circuit comprises a color balance processing circuit configured to change the display gradations of the pixels included in the display image signal by using values of the display gradations of the pixels.

14. The system of claim 8, wherein the gradation changing circuit comprises a dithering processing circuit configured to change a value of a Bayer table.

15. The system of claim 8, wherein the dithering processing circuit changes a value of a Bayer table for a pixel, in which the display gradation is a first dithering determination value or more, among the respective pixels included in the display image signal, or for a pixel thereamong, in which the difference in display gradation from the adjacent pixel is smaller than a second dithering determination value.

* * * * *